US008905780B2

(12) United States Patent
Vallon et al.

(10) Patent No.: US 8,905,780 B2
(45) Date of Patent: Dec. 9, 2014

(54) APPARATUSES AND METHODS RELATING TO EXTENSION CORD WITH INTEGRATED CORD MANAGEMENT

(75) Inventors: Kate Sarah Vallon, Suffern, NY (US); Jonathan Aaron Saxton, New York, NY (US)

(73) Assignee: Quirky, Inc., New York, NY (US)

( * ) Notice: Subject to any disclaimer, the term of this patent is extended or adjusted under 35 U.S.C. 154(b) by 25 days.

(21) Appl. No.: 13/569,824

(22) Filed: Aug. 8, 2012

(65) Prior Publication Data

US 2013/0115804 A1 May 9, 2013

Related U.S. Application Data

(60) Provisional application No. 61/556,874, filed on Nov. 8, 2011, provisional application No. 61/622,761, filed on Apr. 11, 2012.

(51) Int. Cl.

| | |
|---|---|
| ***H01R 13/72*** | (2006.01) |
| ***H01R 25/00*** | (2006.01) |
| ***H01R 13/514*** | (2006.01) |
| ***H01R 35/04*** | (2006.01) |

(52) U.S. Cl.

CPC ..... *H01R 13/72* (2013.01); *H01R 25/003* (2013.01); *H01R 13/514* (2013.01); *H01R 35/04* (2013.01)

USPC ..... 439/501

(58) Field of Classification Search

USPC ..... 439/501, 4, 21, 652, 620.22; 242/400, 242/417

See application file for complete search history.

(56) References Cited

U.S. PATENT DOCUMENTS

| | | | | | |
|---|---|---|---|---|---|
| D195,463 | S | * | 6/1963 | Tamarin | D13/137.4 |
| 3,715,458 | A | * | 2/1973 | Bayes et al. | 174/113 R |
| 3,837,448 | A | * | 9/1974 | Hagstrom | 191/12.4 |
| 4,099,824 | A | | 7/1978 | Schooelrey | |
| 4,467,979 | A | * | 8/1984 | Koehler | 242/396.1 |
| 4,984,685 | A | * | 1/1991 | Douglas | 206/702 |
| 5,544,836 | A | * | 8/1996 | Pera | 242/372 |
| 5,562,488 | A | | 10/1996 | Neiser et al. | |
| 5,690,198 | A | * | 11/1997 | Lohr | 191/12.2 R |
| 5,700,150 | A | * | 12/1997 | Morin | 439/4 |
| 5,701,981 | A | * | 12/1997 | Marshall et al. | 191/12.4 |
| 6,004,138 | A | | 12/1999 | Habertson | |
| 6,077,109 | A | * | 6/2000 | Prazoff | 439/501 |
| 6,227,502 | B1 | * | 5/2001 | Derman | 248/74.4 |
| 6,281,443 | B1 | * | 8/2001 | Idler | 174/110 R |
| 6,597,557 | B2 | * | 7/2003 | Hunter | 361/118 |
| 6,648,677 | B1 | * | 11/2003 | Boyd | 439/501 |

(Continued)

OTHER PUBLICATIONS

International Search Report of PCT/US12/50108 Oct. 22, 2012.

*Primary Examiner* — Alexander Gilman

(74) *Attorney, Agent, or Firm* — Cowan, Liebowitz & Latman, P.C.; Steven D. Underwood

(57) ABSTRACT

One exemplary aspect comprises an apparatus comprising: (a) a first housing comprising an electrical plug; (b) a second housing comprising an electrical receptacle; and (c) a first electrical cord connecting the first housing to the second housing; wherein the second housing is configured to accept the electrical cord being wound around the second housing. In an exemplary embodiment, the apparatus further comprises a third housing comprising an electrical receptacle; and a second electrical cord connecting the second housing to the third housing; wherein the third housing is configured to accept the second electrical cord being wound around the second housing.

11 Claims, 10 Drawing Sheets

(56) References Cited

U.S. PATENT DOCUMENTS

| | | | | |
|---|---|---|---|---|
| 6,702,077 | B2 * | 3/2004 | Skowronski | 191/12.2 R |
| 7,036,761 | B2 * | 5/2006 | Washington et al. | 242/417.2 |
| 7,052,281 | B1 * | 5/2006 | Meyberg et al. | 439/4 |
| 7,168,538 | B2 * | 1/2007 | Pena | 191/12.2 R |
| 7,172,456 | B1 * | 2/2007 | Nagy | 439/501 |
| 7,438,258 | B2 * | 10/2008 | Chen | 242/614 |
| 7,562,689 | B1 * | 7/2009 | Militello et al. | 160/84.04 |
| 7,575,436 | B1 * | 8/2009 | Devlin et al. | 439/21 |
| 7,607,618 | B2 * | 10/2009 | Mori et al. | 248/68.1 |
| 7,753,682 | B2 * | 7/2010 | Gerard | 439/13 |
| 7,845,974 | B2 * | 12/2010 | Yue et al. | 439/501 |
| 2007/0123108 | A1 | 5/2007 | Ivanova et al. | |
| 2010/0130026 | A1 * | 5/2010 | Honda | 439/21 |
| 2011/0045677 | A1 * | 2/2011 | Devlin et al. | 439/21 |

* cited by examiner

APPARATUSES AND METHODS RELATING TO EXTENSION CORD WITH INTEGRATED CORD MANAGEMENT

CROSS-REFERENCE TO RELATED APPLICATIONS

This application claims priority to U.S. Provisional Patent Application No. 61/556,874, filed Nov. 8, 2011, entitled "Multi-Outlet Extension Cord with Integrated Cord Management." This application also claims priority to U.S. Provisional Patent Application No. 61/622,761, filed Apr. 11, 2012, entitled "Extension Cord with Integrated Cord Management." The entire contents of each of the above-referenced applications are incorporated herein by reference.

INTRODUCTION

Exemplary embodiments of apparatuses and methods relating to an extension cord with integrated cord management and methods for use are described herein. An exemplary embodiment comprising an extension cord with integrated cord management may be used, for example, to supply power to one or more electronic devices while maintaining any extra cord length in a managed configuration. More specifically, the extension cord may be configured to be moved between a first configuration, where the extension cord is extended, and a second configuration, where the extension cord is wound around one or more electrical receptacles.

Some embodiments comprise a multi-outlet extension cord with a plurality of electrical receptacles spaced apart from each other along the extension cord to supply power to one or more electronic or electrical devices.

An exemplary aspect comprises an apparatus comprising: (a) a first housing comprising an electrical plug; (b) a second housing comprising an electrical receptacle; and (c) a first electrical cord connecting the first housing to the second housing; wherein the second housing is configured to accept the electrical cord being wound around the second housing.

In various exemplary embodiments: (1) the second housing comprises two parallel circular disk components having a first diameter, the disk components connected by a cylindrical component having a second diameter, the first diameter being greater than the second diameter; (2) the second housing comprises two parallel annular components having a first diameter, the annular components connected by a cylindrical component having a second diameter, the first diameter being greater than the second diameter; (3) the first diameter is sufficiently greater than the second diameter to define a space between the disk components sufficiently large to contain essentially the entire length of the first electrical cord when essentially the entire length of the first electrical cord is wound around the cylindrical component; (4) the first diameter is sufficiently greater than the second diameter to define a space between the annular components sufficiently large to contain essentially the entire length of the first electrical cord when essentially the entire length of the first electrical cord is wound around the cylindrical component; (5) the first housing comprises means for rotating the first housing about the electrical plug; (6) a ratchet for rotating the first housing about the electrical plug is disposed within the first housing; (7) the apparatus further comprises a third housing comprising an electrical receptacle; and a second electrical cord connecting the second housing to the third housing; wherein the third housing is configured to accept the second electrical cord being wound around the second housing; (8) the first electrical cord comprises means for attaching a first section of the first electrical cord to a second section of the first electrical cord when at least a part of the first electrical cord is wound around the first housing; (9) the first electrical cord comprises one or more protrusions on a first surface extending along a longitudinal axis of the first electrical cord, and one or more corresponding channels on a second surface opposite the first surface, the one or more protrusions and one or more corresponding channels configured to enable attachment of the first electrical cord to itself when wound around the first housing; (10) the apparatus further comprises one or more clips attached to a first section of the first electrical cord and configured to accept a second portion of the electrical cord; (11) the apparatus further comprises means for mounting the second housing to a surface; (12) the surface comprises a wall or table surface; (13) the apparatus further comprises means for attaching one or more segments of the first electrical cord to the housing; (14) the apparatus further comprises means for attaching to the housing one or more segments of an electrical cord of a device utilizing the electrical receptacle.

Another exemplary aspect comprises a method comprising: (a) connecting an electrical device to the electrical receptacle of claim 1; and (b) wrapping an electrical cord of the electrical device around the second housing.

These and other aspects and embodiments will become apparent to those skilled in the art after reviewing the description below in conjunction with the drawings.

DETAILED DESCRIPTION OF CERTAIN EXEMPLARY EMBODIMENTS

Figure 1B:
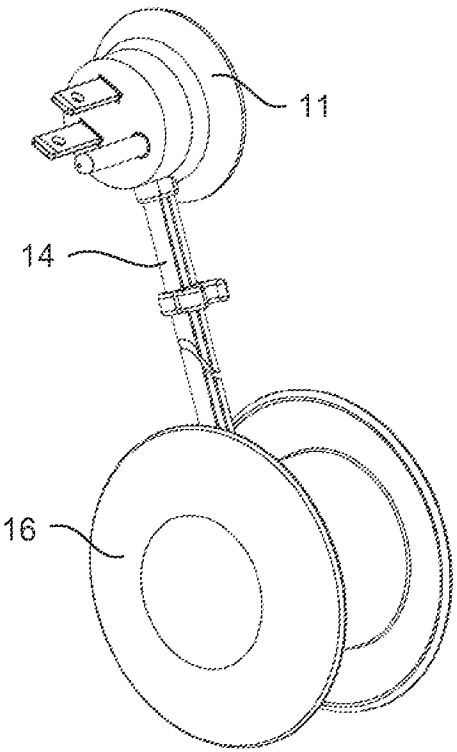
FIGS. 1A and 1B depict an exemplary embodiment comprising an extension cord having a single hub with a single receptacle.
Figure 1A:
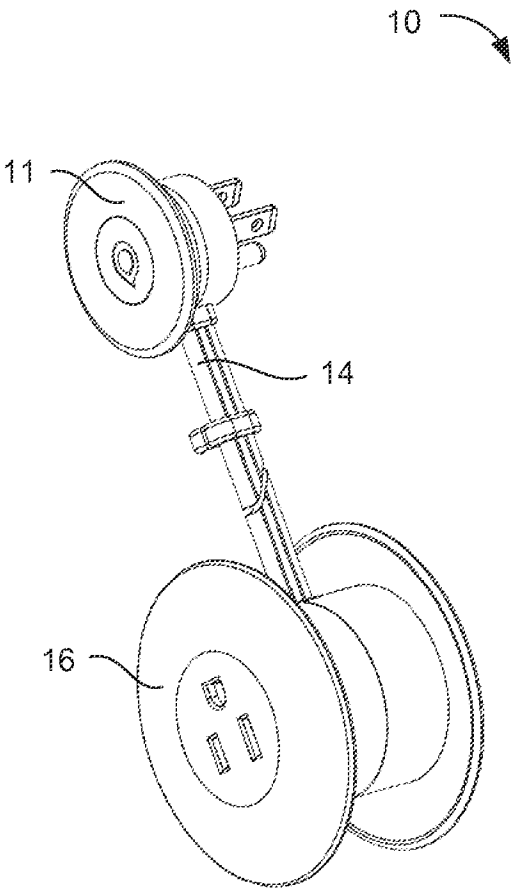

Referring to FIGS. 1A and 1B, in an exemplary embodiment an extension cord assembly 10 may include a plug assembly 11, an electrical cord 14, and an electrical receptacle 16 on a single hub. The plug assembly 11 may be disposed at one end of the assembly 10 and the electrical receptacle 16 may be disposed at a second end. FIGS. 1A and 1B are exemplary front and back perspective views of assembly 10 with an electrical receptacle 16 located on one side of the hub. The electrical cord 14 may be configured to couple to an electrical component (e.g., the plug assembly 11 and the electrical receptacle 16) to complete an electrical circuit, described in further detail herein.

In the first configuration, the electrical cord 14 may extend between two adjacent components (the plug assembly 11 and the electrical receptacle 16). In the second configuration, a portion of the electrical cord 14 is wound around the electrical receptacle 16. Similarly stated, the electrical cord 14 is configured to be wrapped around the hub and/or electrical receptacle 16 when in the second configuration and substantially not wrapped around the electrical receptacle 16 when in the first configuration. For example, in some embodiments, the extension cord assembly 10 may be in the first configuration and an electrical component may be disposed such that the space between the electrical component and the plug assembly 11 is equal to the fully extended length of the extension cord 14 between the plug assembly 11 and the electrical receptacle 16.

Figure 2B:
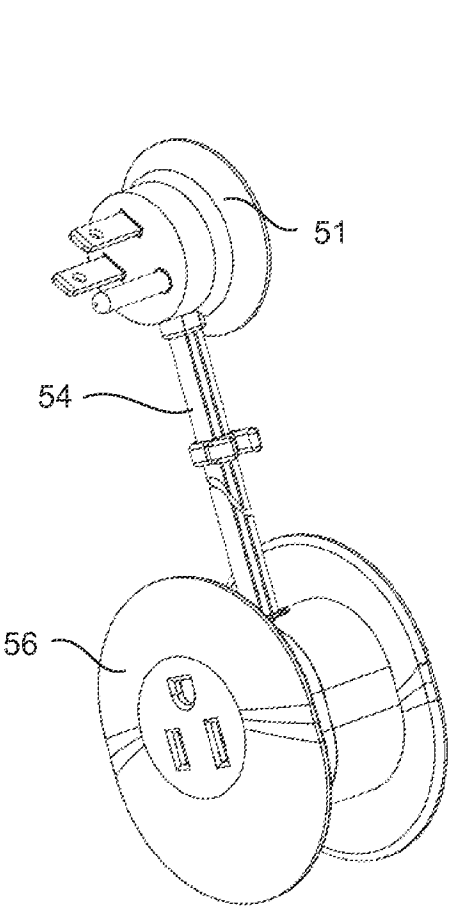
FIGS. 2A and 2B depict an exemplary embodiment comprising an extension cord having a single hub with a receptacle on each side.
Figure 2A:
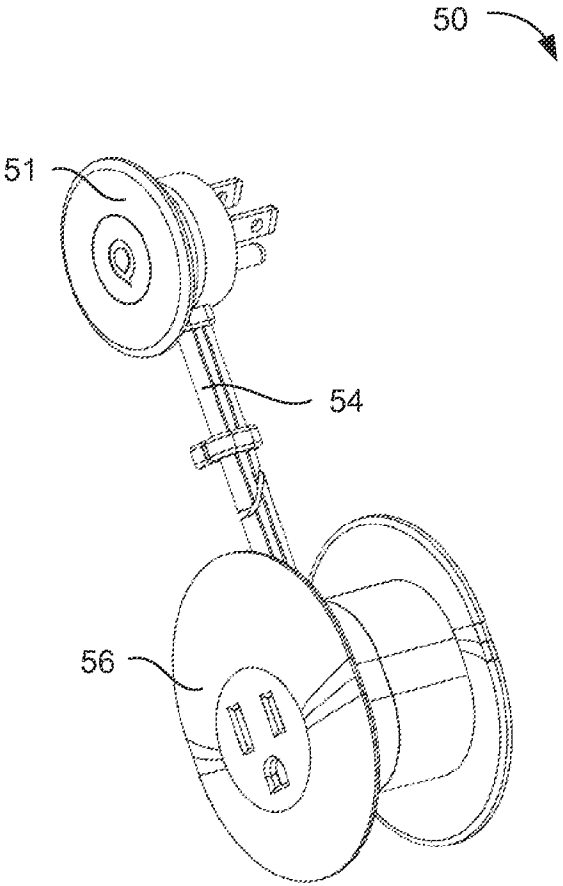

Referring to FIGS. 2A and 2B, an exemplary extension cord assembly 50 may include a plug assembly 51, an electrical cord 54, and two electrical receptacles 56 on a single hub. The plug assembly 51 may be disposed at one end of the extension cord 50 and the electrical receptacles 56 may be disposed at a second end.

FIGS. 2A and 2B are front and back perspective views of the extension cord assembly 50 with an electrical receptacle 56 located on both sides of the hub. The extension cord assembly 50 may be configured to be used in the same manner as the extension cord assembly 10 described above. In some embodiments, each hub may include additional electrical receptacles 56 and/or additional receptacles such as, for example, telephone cord (with RJ-11 jacks/plugs), CAT-5 cable (with RJ-12 jacks/plugs), USB cable, twisted pair, coax, Firewire, HDMI, optical, etc. Those skilled in the art will understand that various embodiments may use cords that provide power, data (including audio and video data), and other electrical and/or optical signals. Various voltages (e.g., 110, 115, 120, 220, and/or 240) may be used, as well as various international plug/outlet configurations.

In some embodiments, the electrical cord of the device being plugged into the extension cord assembly 50 may also be wrapped around the hub for cord management. In some embodiments, a user may wrap excess cord from a device or appliance around one or more of the hubs.

Figure 3A:
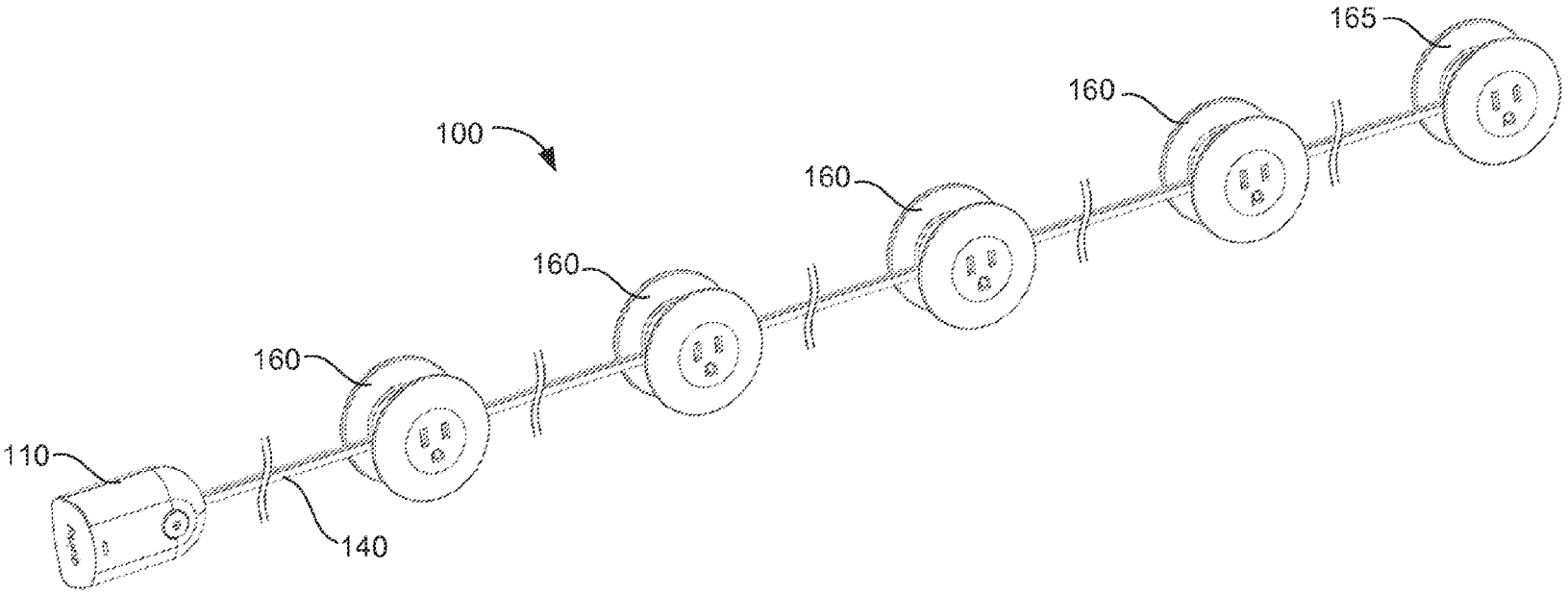
FIGS. 3A and 3B depict an exemplary embodiment comprising an extension cord having multiple receptacle hubs.
Figure 3B:
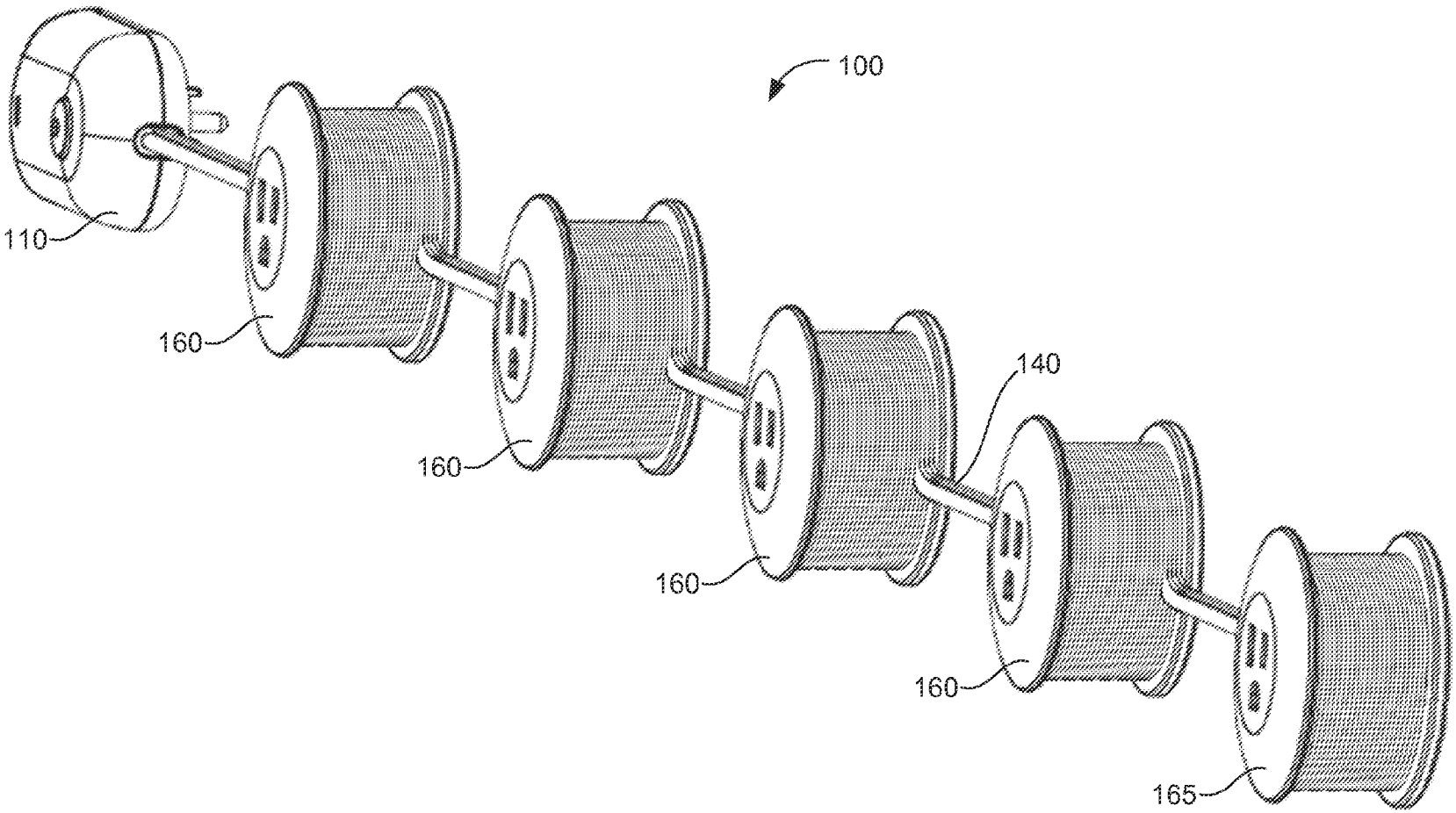

Referring to FIGS. 3A and 3B, an extension cord assembly 100 may include a plug assembly 110, an electrical cord 140, and one or more electrical receptacle hubs 160. The plug assembly 110 may be disposed at one end of the extension cord 100 and a terminating electrical receptacle hub 165 may be disposed at a second end. The electrical cord 140 may be configured to couple to adjacent electrical components (e.g., the plug assembly 110 and the adjacent electrical receptacle hub 160 or two adjacent electrical receptacle hubs 160, 165) to complete an electrical circuit, described in further detail herein. In the first configuration (FIG. 3A), the electrical cord 140 may extend between two adjacent components.

In the second configuration, a portion of the electrical cord 140 is wound around the electrical receptacles 160. Similarly stated, the electrical cord 140 is configured to be wrapped around the electrical receptacle hubs 160 when in the second configuration and substantially not wrapped around the electrical receptacle hubs 160 when in the first configuration. For example, in some embodiments, the extension cord 100 may be in the first configuration and adjacent electrical components may be disposed such that the space between the adjacent electrical components is equal to the fully extended length of the extension cord 140 between the adjacent electrical components. While shown in FIGS. 3A and 3B as including five electrical receptacle hubs 160, the extension cord assembly 100 may include any number of electrical receptacle hubs 160. For example, in some embodiments, the extension cord 100 may include less than five electrical receptacle hubs 160, while in other embodiments, the extension cord 100 may include more than five electrical receptacle hubs 160.

In terms of exemplary usage, either section of cord 140 that is adjacent to a hub 160 may be wound around the hub, although it is contemplated that ordinarily a user will be winding around a hub the cord section that is closest to plug housing 110. For example, referring to FIG. 3B, it is contemplated that a user will ordinarily wind the cord section between receptacle housing 165 and the adjacent receptacle housing 160 around receptacle housing 165, and that the cord section on the other side of that housing 160 (i.e., the housing 160 that is adjacent to housing 165) will be wound around that housing 160, and so forth.

Figure 4A:
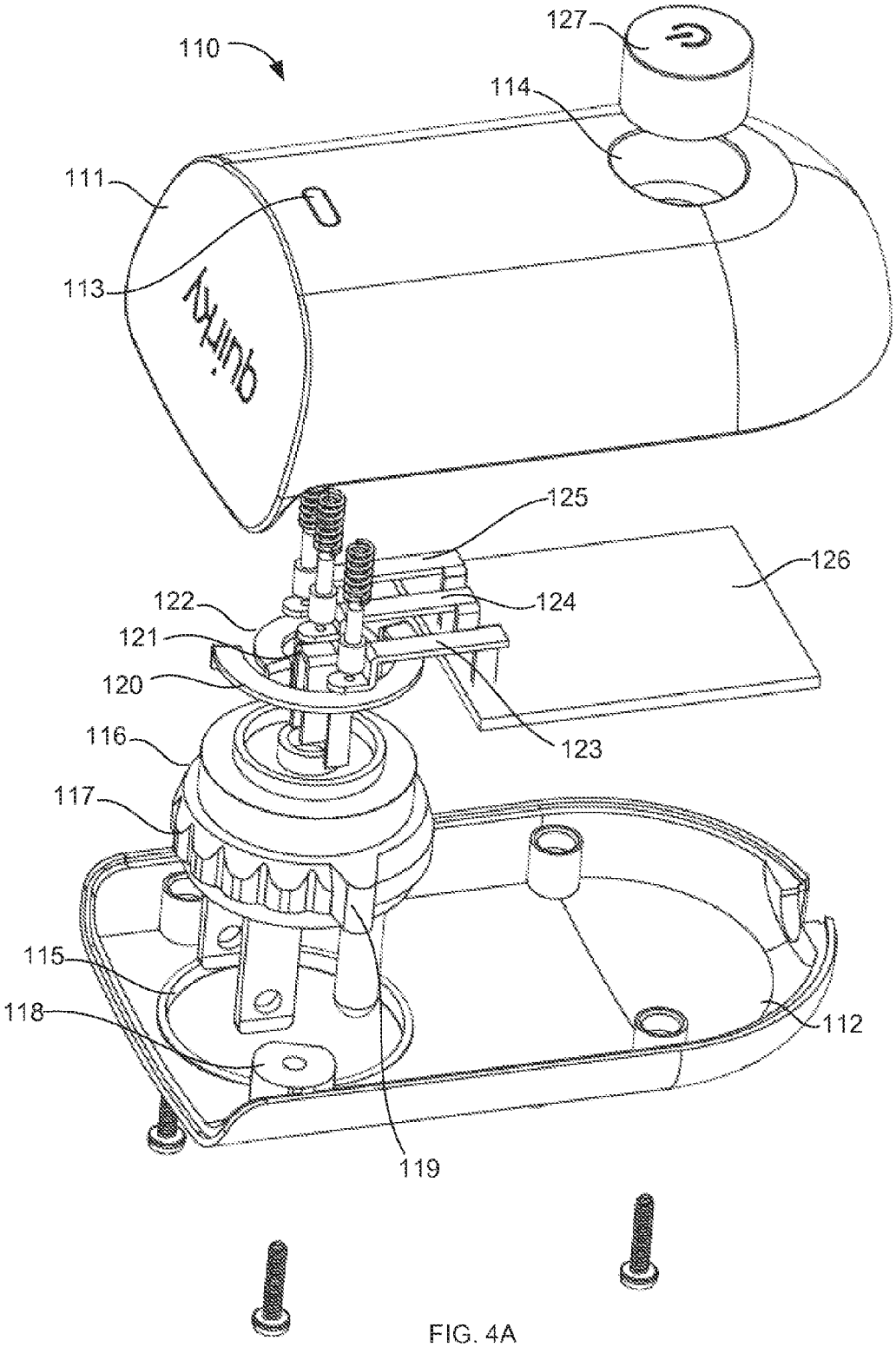
FIGS. 4A-4C depict an exemplary embodiment comprising a rotatable plug housing and assembly.
Figure 4B:
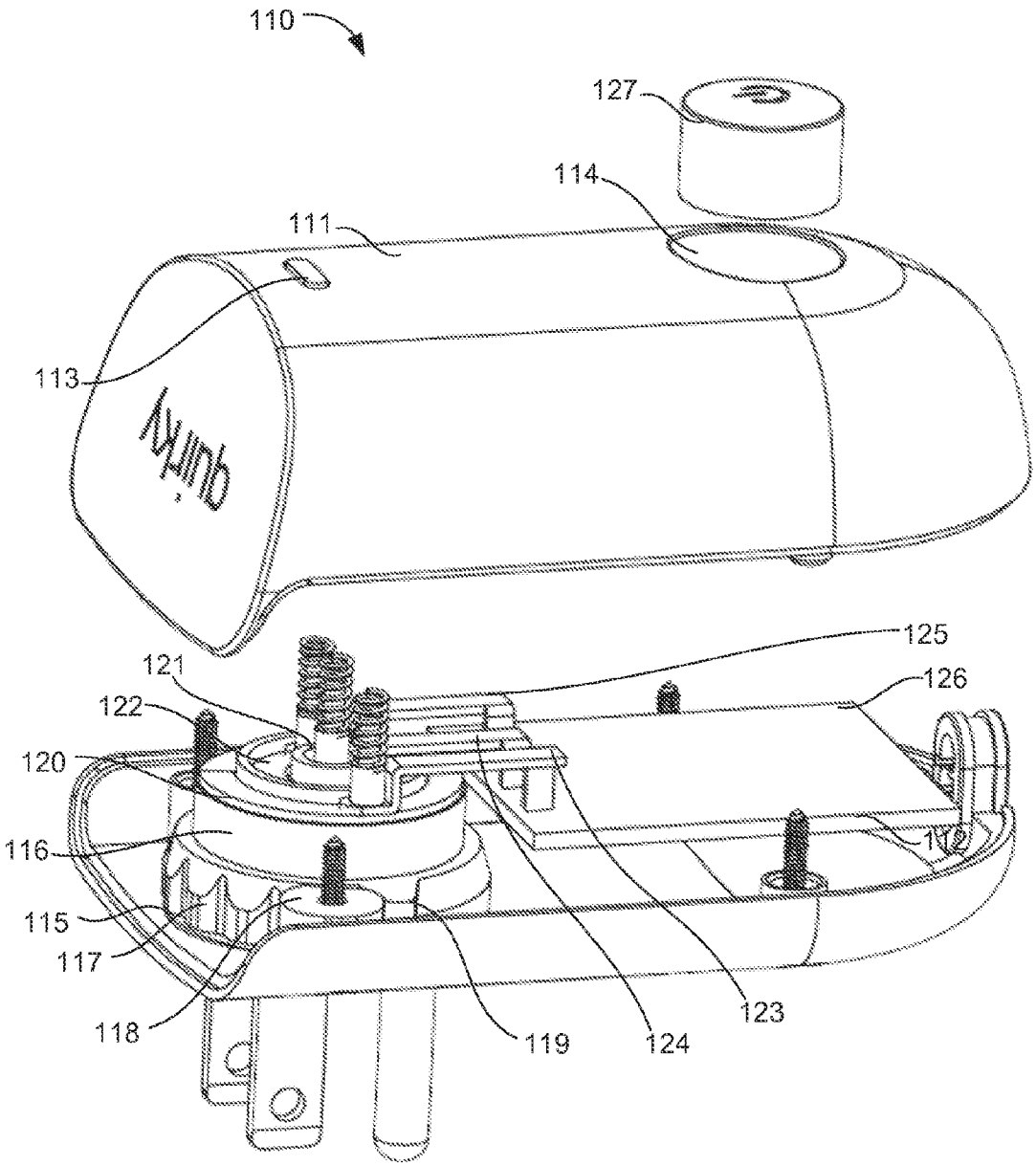
Figure 4C:
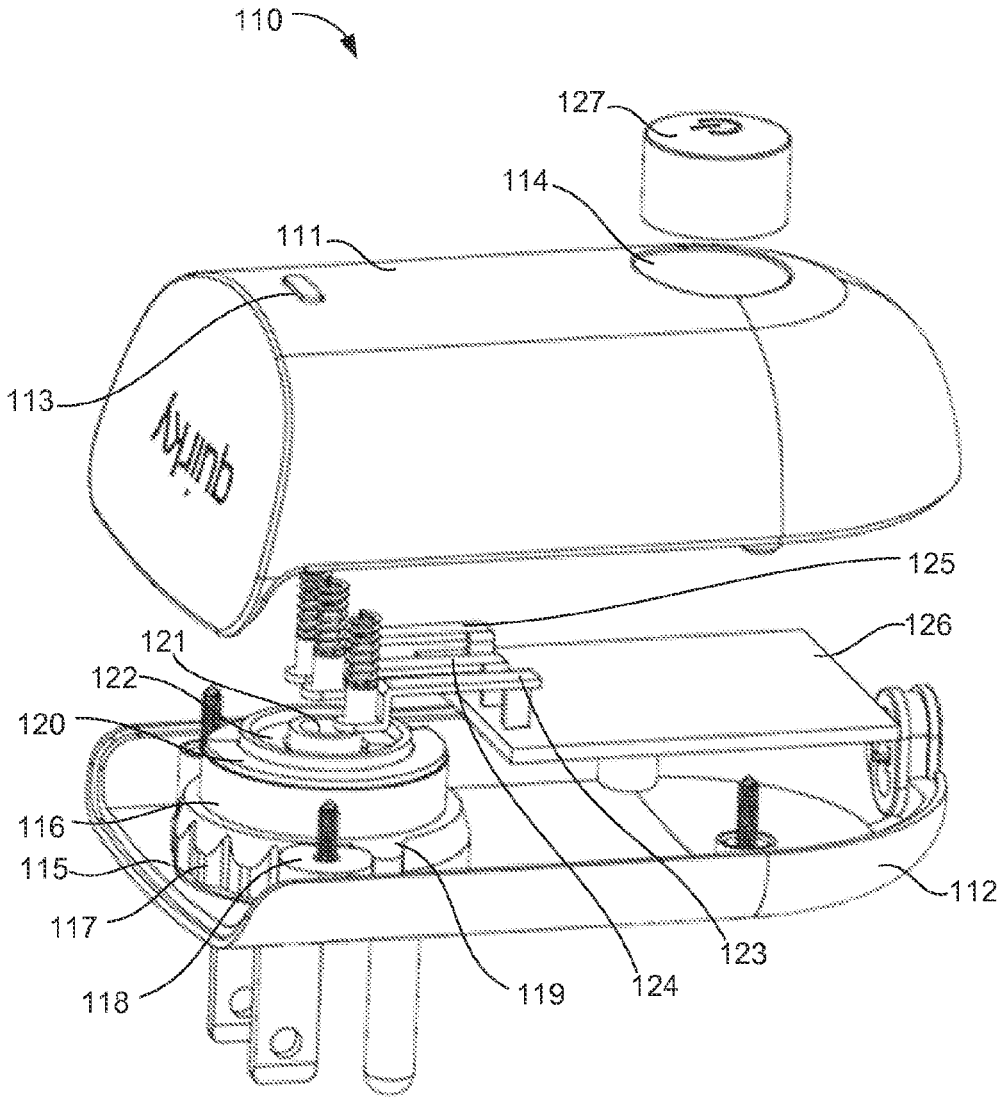

Referring to FIGS. 4A-4C, the plug assembly 110 includes a first housing member 111 and a second housing member 112. The first housing member 111 defines a light aperture 113 and a power button cavity 114. The light aperture 113 may receive a light, such as, for example, a light emitting diode ("LED"), configured to be a visual indicator of the power status of the extension cord assembly 100. For example, in some embodiments, the light can be on when the extension cord assembly 100 is powered on (e.g., current flowing through the electrical circuit) and the light can be off when the extension cord 100 is powered off (e.g., no current flowing through the electrical circuit). In other embodiments, the two different colored LEDs may be disposed within the light aperture, with a first color configured to indicate the extension cord assembly 100 is powered on and a second color configured to indicate the extension cord is powered off.

The second housing member 112 includes a ratchet protrusion 118 and defines a plug opening 115 configured to receive a portion of a plug mechanism 116. The second housing member 112 may be coupled to the first housing member 111 using any suitable coupling, such as, for example, screws, pins, tabs, and/or the like. When coupled, the first housing member 111 and the second housing member 112 define an electrical cord aperture (not shown in FIGS. 4A-4C) configured to receive a portion of the electrical cord 140.

As described above, the plug mechanism 116 may be disposed within the plug opening 115. The plug mechanism 116 includes a set of ratchet teeth 117, a stop 119, a first electrical conductor 120, a second electrical conductor 121, and a third electrical conductor 122. The plug mechanism 116 may be configured to rotate within the plug opening 115 and the ratchet protrusion 118 may engage the ratchet teeth 117 such as to maintain the plug mechanism 116 in discreet positions as the plug mechanism 116 rotates within the plug opening 115. The stop 119 included in the plug mechanism 116 may be configured to engage a portion of the second housing member 112 to limit the rotational motion of the plug mechanism 116. For example, in some embodiments, the arrangement of the second housing member 112 and the stop 119 may limit the rotation of the plug mechanism 116 between 0 degrees and 180 degrees. In some embodiments, the plug mechanism 116 may be fixedly coupled to the housing members 111, 112 such that the plug mechanism 116 cannot rotate within the plug assembly 110. Those skilled in the art will understand that a ratchet mechanism is optional—i.e., a ratchet mechanism may be omitted in certain embodiments. Other means of enabling rotation may be used (for example, tongue-and-groove, ball-and-socket, etc.), or the plug may be fixed (no rotation).

The plug mechanism 116 may be configured to selectively engage a first electrical arm 123, a second electrical arm 124, and a third electrical arm 125. The plug assembly 110 includes a power button 127 and a power control board 126 configured to place the extension cord 100 in a powered on configuration, such as, for example, in FIG. 4B and a powered off configuration, such as, for example, in FIG. 4C.

In the powered on configuration, the power button 127 may be actuated such that the power control board 126 may place the first electrical arm 123, the second electrical arm 124, and the third electrical arm 125 in contact (e.g., physical and electrical contact) with the first electrical conductor 120, the second electrical conductor 121, and the third electrical conductor 122, respectively. The first electrical conductor 120, the second electrical conductor 121, and the third electrical conductor 122 are configured such that when the extension cord 100 is in the powered on configuration, the electrical conductors 120, 121, and 122 stay in contact (e.g., physical and electrical) with the electrical arms 123, 124, and 125, respectively, through the range of rotational motion of the plug mechanism 116. The electrical cord 140 may be coupled to the first electrical arm 123, the second electrical arm 124, and the third electrical arm 125 to carry an electrical current to the electrical receptacle hubs 160, when in the powered on configuration.

In the powered off configuration, the power button 127 may be actuated such that the power control board 126 may maintain the first electrical arm 123, the second electrical arm 124, and the third electrical arm 125 in separation (e.g., physical and electrical) from the first electrical conductor 120, the second electrical conductor 121, and the third electrical conductor 122, respectively.

In some embodiments, the power button 127 and the power control board 126 may be operably coupled by a spring mechanism (not shown) such that, in actuating the power button 127 the spring is configured to move the power control board 126, placing the extension cord 100 in the powered on or powered off configuration.

In other embodiments, the actuating of the power button 127 may activate a latch mechanism (not shown) configured to move the power control board 126, placing the extension cord 100 in the powered on or powered off configuration. Although not shown, the plug mechanism 116 may include a printed circuit board configured to selectively place the extension cord 100 in a powered on configuration, and to be operable by the power button 127. The printed circuit board may also provide surge protection to the extension cord 100. In such embodiments, the printed circuit board may include varistors, such as, for example, metal oxide varistors to provide the surge protection.

Figure 5:
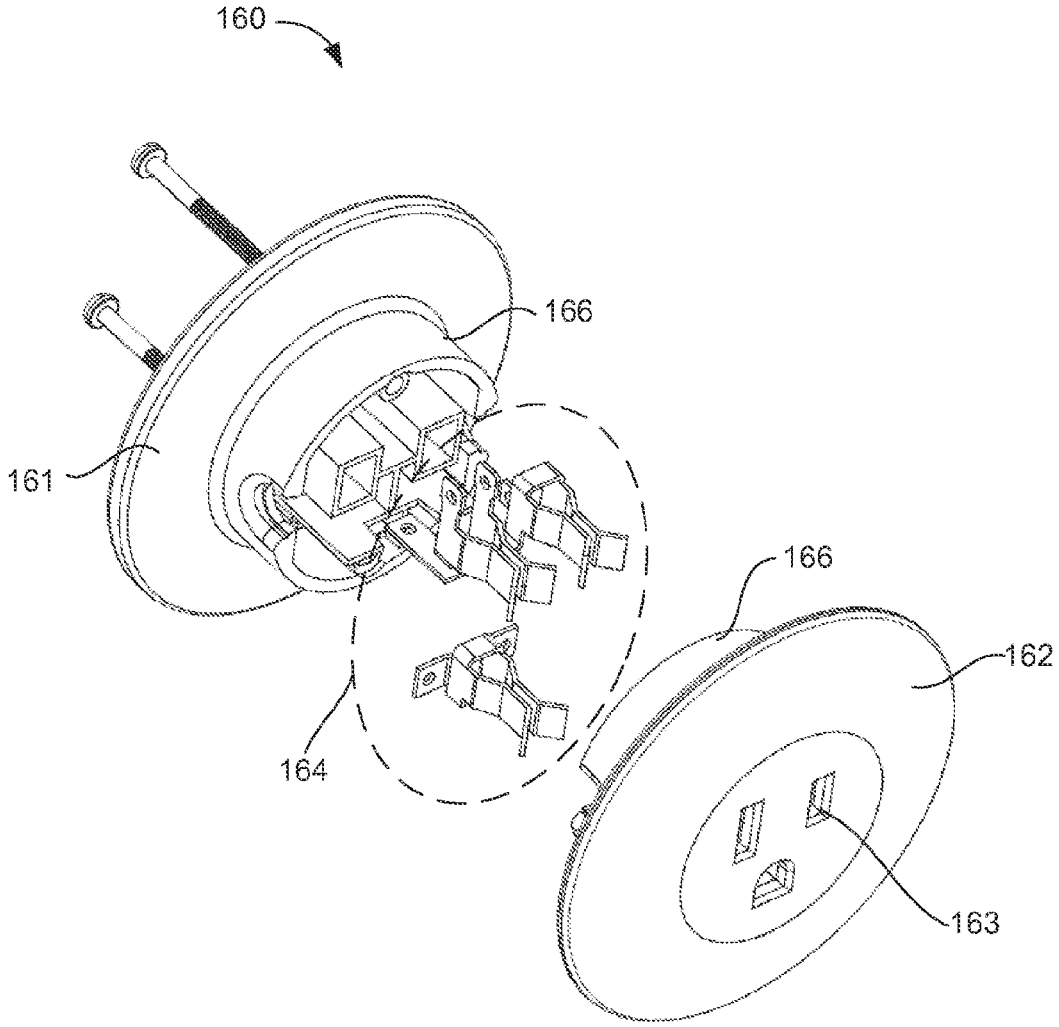
FIG. 5 depicts an exemplary embodiment comprising a receptacle housing and assembly.

Referring to FIG. 5, the receptacle hubs 160 each include a first housing member 161 and a second housing member 162 that are configured to couple together and house electrical members 164. The first housing member 161 and/or second housing member 162 may include a means for hanging or mounting to allow the receptacle hubs 160 to be hung or mounted on a wall or fastened, for example, to a table edge. For example, the first housing member 161 may include an aperture (not shown) configured to receive the head of a nail or screw. In some embodiments, the hanging/mounting means may comprise a slot, a hook or a loop of wire.

The second housing member 162 includes a set of plug openings 163 configured to receive an electrical plug. In this manner, the electrical members 164 engage the electrical plug similarly to known devices. In some embodiments, the electrical members 164 and the plug opening 163 may be configured to receive one or more USB plugs.

The first housing member 161 may be coupled to the second housing member 162 using any suitable mechanism. For example, in some embodiments, the first housing member 161 may be coupled to the second housing member 162 using screws, pins, tabs, adhesives, ultrasonic welding, etc. When the first housing member 161 is coupled to the second housing member 162, the first housing member 161 and the second housing member 162 define an outer surface 166 that the electrical cord 140 may be wrapped around. The outer surface 166 defines at least one aperture (not shown) configured to receive a first portion of the electrical cord 140 such that the electrical cord 140 may couple to the electrical members 164. Additionally, a second portion of the electrical cord 140 may be configured to exit the aperture and/or apertures to couple to the adjacent electrical component. In this manner, the electrical cord 140 may physically and electrically couple the electrical components together (e.g., the plug assembly 110 and the receptacle hubs 160). While the receptacle hubs are depicted in FIG. 5 as each having a receptacle on only one side, those skilled in the art will recognize that the hubs also may each have two receptacles (one on each side), as shown in FIGS. 2A and 2B.

Figure 6A:
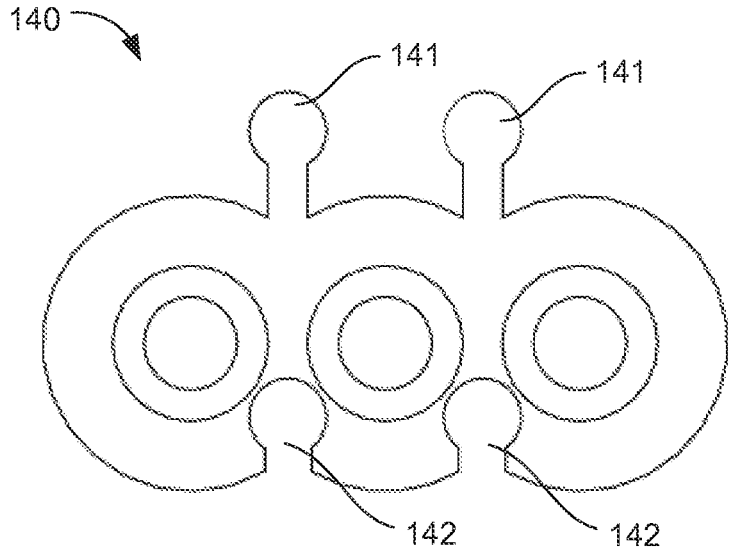
FIGS. 6A and 6B depict an exemplary embodiment comprising an electrical cord having protrusions and corresponding channels.
Figure 6B:
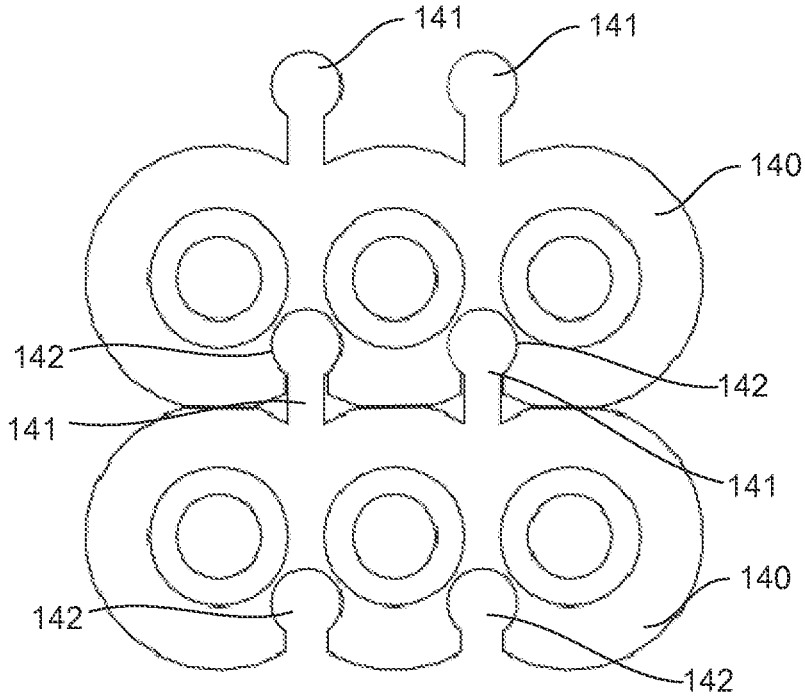

The electrical cord 140 may comprise any suitable electrical cord. For example, as shown in FIGS. 6A and 6B, the electrical cord 140 may include a set of protrusions 141 and define a set of channels 142. When a first portion of the electrical cord 140 is disposed over a second portion of the electrical cord 140, such as, for example, when in the second configuration, the protrusions 141 may be disposed within the channels 142, as shown in FIG. 6B. In this manner, the protrusions 141 form a friction or interference fit with the channels 142 and the electrical cord 140 may maintain the extension cord 100 in the second configuration until a user removes the first portion of the electrical cord 140 from contact with the second portion of the electrical cord 140.

Figure 7A:
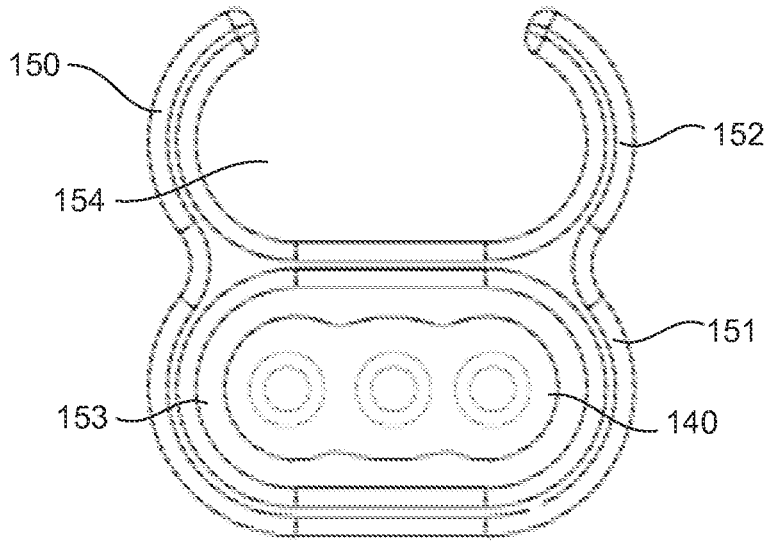
FIGS. 7A and 7B depict an exemplary embodiment comprising an electrical cord having one or more clips.
Figure 7B:
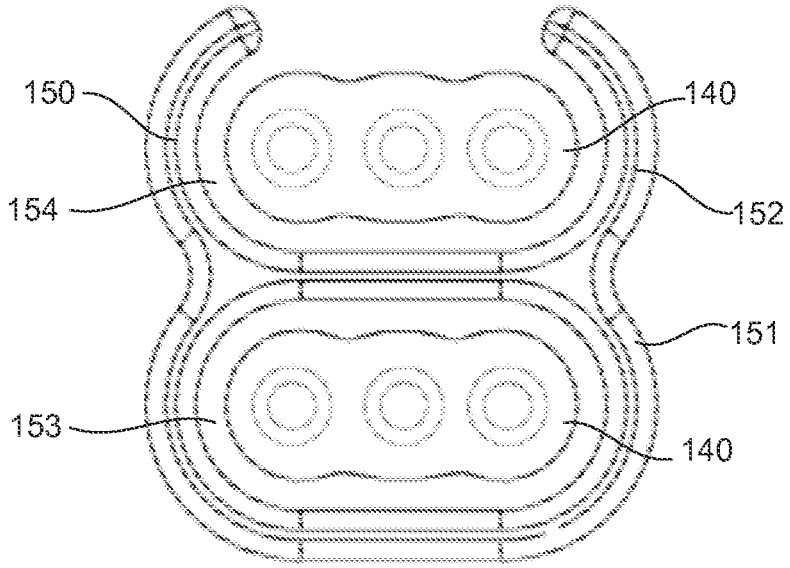

In some embodiments, the electrical cord 140 may include clips 150 configured to allow a user to manage the length of the extension cord 100 and vary the distance between adjacent receptacle hubs 160, as shown in FIGS. 7A and 7B. In such embodiments, a first portion of the electrical cord 140 may be disposed within an aperture 153 defined by a first portion 151 of the clip 150. The first portion 151 of the clip 150 may be configured such that the clip 150 may slide along the length of the electrical cord 140 and may be configured to prevent the clip 150 from being removed from the first portion 151 of the electrical cord 140.

Similarly stated, the electrical cord 140 is non-removably disposed within the aperture 153 of the first portion 151 of the clip 150. The clip 150 further includes a second portion 152 configured to receive a second portion of the electrical cord 140, such as, for example, when the extension cord 100 is in the second configuration. More specifically, the second portion 152 defines an opening 154 configured to receive the second portion of the electrical cord 140, such that the second portion of the electrical cord 140 is removably disposed within the opening 154 defined by the second portion 152 of the clip 150. While it is contemplated that only one clip between receptacle hubs will ordinarily be used, more than one clip also may be used.

Moreover, those skilled in the art will understand that means other than protrusions or clips may be used to attach cord to cord, and/or cord to a hub. For example, one cord segment may be affixed to another segment, or to a hub, using a hook-and-loop, flexible wire, or other fastener.

In some embodiments, the extension cord assembly 100 may be placed in any of a variety of configurations between the first configuration and the second configuration to space the electrical receptacle hubs 160, 165 predetermined distances from adjacent electrical receptacle hubs 160, 165. For example, two adjacent receptacle hubs 160 may be placed next to each other to allow a plurality of electrical devices (e.g., power tools, electronics, etc.) to be plugged into the extension cord 100 while the next receptacle 160, 165 in the line is spaced a predetermined distance (e.g., 3, 4, or 5 feet) from the two adjacent receptacle hubs 160.

In other embodiments, all of the electrical receptacle hubs 160, 165 may be equally or irregularly spaced depending on the user's needs. Moreover, the extension cord assembly 100 may be placed in the second configuration to reduce a tripping hazard produced by any extra length of electrical cord 140 at the feet of the user, or to reduce the storage size of the extension cord assembly 100 and to reduce the likelihood of ensnaring other objects.

As shown, electrical cord 140 has a substantially oval cross-section and is a grounded power cord, with three conductive elements, e.g. two power and one ground and the electrical receptacle hubs 160 are grounded receptacles, i.e. configured to receive a three-prong grounded plug. In some embodiments, other cord configurations and cross-sections (e.g., round, rectangular, etc.) may be used, e.g. in conjunction with appropriate receptacles, such as for example, telephone cord (with RJ-11 jacks/plugs), CAT-5 cable (with RJ-12 jacks/plugs), USB cable, twisted pair, coax, Firewire, HDMI, optical, etc. Those skilled in the art will understand that various embodiments may use cords that provide power, data (including audio and video data), and other electrical and/or optical signals. Various voltages (e.g., 110, 115, 120, 220, and/or 240) may be used, as well as various international plug/outlet configurations.

In an exemplary embodiment, the cylindrical, central portion of a receptacle hub is rotatable with respect to the end portions (each end portion typically a disk or annulus shaped component). This enables a cord section that extends from the central portion to rotate with respect to the end portions.

Moreover, while the exemplary receptacle hubs 160 are depicted as spool-shaped (i.e., a round cylinder with a round disk or annulus at each end), those skilled in the art will understand that other shapes may be used. For example, the cylinder may be square, oval, octagonal, etc.; and the ends may be any suitable shape as well. Square ends, for example, may be used in order to provide greater stability to each receptacle hub.

Also, although the receptacles 160, 165 are depicted in one embodiment as being linearly connected, other configurations, such as two or more cords/receptacles depending from each single receptacle, or from only certain receptacles, also are within the scope of the invention.

More generally, while certain exemplary embodiments are described herein, it should be understood that those embodiments are presented by way of example only, and not limitation. While the embodiments have been particularly shown and described, it will be understood that various changes in form and details may be made. Although various embodiments have been described as having particular features and/or combinations of components, other embodiments are possible having a combination of any features and/or components from any of embodiments as discussed above.

We claim:

1. An apparatus comprising:

a first housing enclosing an electrical plug;

a second housing enclosing an electrical receptacle;

a first electrical cord connecting said first housing to said second housing;

wherein said second housing is configured to accept said electrical cord being wound around said second housing, wherein said second housing comprises a first pair of parallel annular components having a first outside diameter and connected by a first cylindrical component therebetween having a second outside diameter, said first outside diameter being greater than said second outside diameter, and wherein an annular cylindrical volume between said first pair of parallel annular components and outside said first cylindrical component is large enough to contain essentially the entire length of said first electrical cord when said essentially the entire length of said first electrical cord is wound around said first cylindrical component;

a third housing comprising an electrical receptacle; and a second electrical cord connecting said second housing to said third housing, wherein said third housing is configured to accept said second electrical cord being wound around said third housing, wherein said third housing comprises a second pair of parallel annular components having a third outside diameter and connected by a second cylindrical component therebetween having a fourth outside diameter, said third outside diameter being greater than said fourth outside diameter, and wherein an annular cylindrical volume between said second pair of parallel annular components and outside said second cylindrical component is large enough to contain essentially the entire length of said second electrical cord when said essentially the entire length of said second electrical cord is wound around said second cylindrical component.

2. An apparatus as in claim 1, wherein said first housing comprises means for rotating said first housing about said electrical plug.

3. An apparatus as in claim 1, wherein a ratchet for rotating said first housing about said electrical plug is disposed within said first housing.

4. An apparatus as in claim 1, wherein said first electrical cord comprises means for attaching a first section of said first electrical cord to a second section of said first electrical cord when at least a part of said first electrical cord is wound around said first housing.

5. An apparatus as in claim 1, wherein said first electrical cord comprises one or more protrusions on a first surface extending along a longitudinal axis of said first electrical cord, and one or more corresponding channels on a second surface opposite said first surface, said one or more protrusions and one or more corresponding channels configured to enable attachment of said first electrical cord to itself when wound around said first housing.

6. An apparatus as in claim 1, further comprising one or more clips attached to a first section of said first electrical cord and configured to accept a second portion of said electrical cord.

7. An apparatus as in claim 1, further comprising means for mounting said second housing to a surface.

8. An apparatus as in claim 7, wherein said surface comprises a wall or table surface.

9. An apparatus as in claim 1, further comprising means for attaching one or more segments of said first electrical cord to said second housing.

10. An apparatus as in claim 1, further comprising means for attaching to said second housing one or more segments of an electrical cord of a device utilizing said electrical receptacle.

11. A method comprising:

(a) connecting an electrical device to the electrical receptacle of claim 1; and (b) wrapping an electrical cord of said electrical device around said second housing.

* * * * *